United States Patent [19]

Kawamura

[11] Patent Number: 4,724,547

[45] Date of Patent: Feb. 16, 1988

[54] BUILT-IN CORE BODY IN READY-MADE KNOT OF NECKTIE

[75] Inventor: Hironobu Kawamura, Tokyo, Japan

[73] Assignee: Alps Kawamura Kabushiki Kaisha, Tokyo, Japan

[21] Appl. No.: 8,366

[22] Filed: Jan. 29, 1987

[30] Foreign Application Priority Data

Aug. 7, 1986 [JP] Japan ..... 61-121499[U]

[51] Int. Cl.[4] ..... A41D 25/14

[52] U.S. Cl. ..... 2/153

[58] Field of Search ..... 2/144, 153, 146, 148

[56] References Cited

U.S. PATENT DOCUMENTS

| | | | |
|---|---|---|---|
| 464,886 | 12/1891 | Morris | 2/153 |
| 485,447 | 11/1892 | Beam | 2/153 |
| 704,569 | 7/1902 | Oppenheimer | 2/146 |
| 1,438,885 | 12/1922 | Almedia | 2/153 |
| 1,890,722 | 12/1932 | Davis | 2/146 |
| 2,094,487 | 9/1937 | Gernert | 2/153 |
| 2,142,322 | 1/1939 | Martin | 2/153 |
| 2,473,593 | 6/1949 | Lambrechts | 2/153 |
| 2,710,408 | 6/1955 | Lackland | 2/153 |
| 3,365,726 | 1/1968 | Pulitzer | 2/153 |
| 3,737,917 | 6/1973 | Orr | 2/150 |
| 4,206,513 | 6/1980 | Collins | 2/152 R |
| 4,337,539 | 7/1982 | Najarian | 2/153 |
| 4,489,443 | 12/1984 | Ellin | 2/153 |
| 4,504,979 | 3/1985 | Kawamura | 2/153 |

*Primary Examiner*—Louis K. Rimrodt

*Attorney, Agent, or Firm*—Burns, Doane, Swecker & Mathis

[57] ABSTRACT

A built-in core body (10) for forming a ready-made knot of a necktie, by which a neat knot (4) is easily formed and permanently maintained, comprising an outer shell (11), a presser member (12), and a release member (13). A narrow band (2*b*) of a tie body (2) is inserted in a channel (17) formed in the interior of the outer shell (11) in a double-folded state and the knot (4) is formed around the core body (10) in a conventional manner. The upward movement of the narrow band (2*b*) through the core body (10) is inhibited by the action of the presser member (12) while the downward movement thereof is free. Upward movement of the narrow band (2*b*) is allowed when the release member (13) is operated to release the presser member (12) from engagement with the narrow band (2*b*).

5 Claims, 23 Drawing Figures

Fig. 13
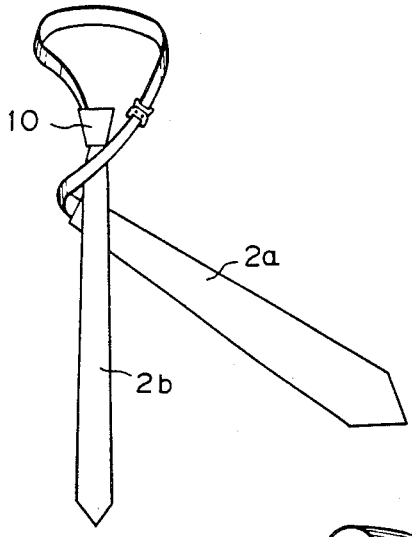
Fig. 14
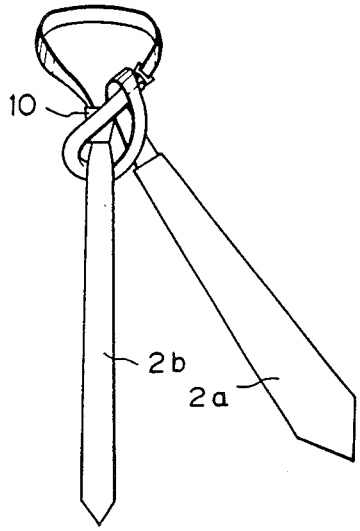
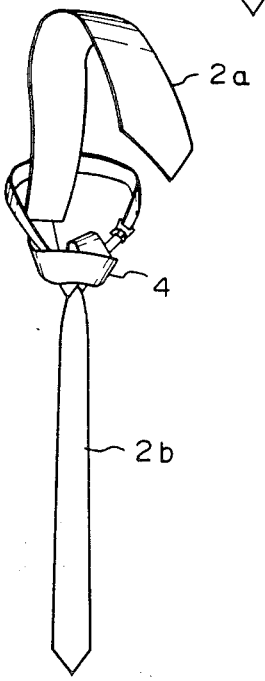
Fig. 15

BUILT-IN CORE BODY IN READY-MADE KNOT OF NECKTIE

BACKGROUND OF THE INVENTION

1. Field of the Invention

This invention relates to a built-in core body in a ready-made knot of a necktie, for maintaining a neat shape of the knot and for enabling a narrow band portion of the tie body to easily slide therethrough when putting on or taking off the necktie.

2. Description of the Related Arts

A necktie assembly having a ready-made knot is known in the art, such as disclosed in U.S. Pat. No. 4,504,979 granted to the present applicant and issued on Mar. 19, 1985. In the above patent, there is provided a necktie assembly, as shown in FIG. 1, comprising a tie body 2 consisting of wide and narrow bands 2*a* and 2*b* longitudinally connected to each other. The narrow band 2*b* has an interlining (not shown) with a longitudinal slot along at least a portion thereof. A core body 3, as shown in FIG. 2, is provided for forming a ready-made knot 4 in the tie body, having a curved channel 5. The knot 4 is prepared by longitudinally folding a portion of the narrow band 2*b* along the slot of the interlining and inserting the same into the channel 5 of the core body 3 so that the longitudinally folded state of the band is maintained by frictional engagement with the inner wall of the channel 5. A middle portion of the narrow band 2*b* is then wrapped around the core body 3 to form two layers on the core body 3, and a free end of the wide band 2*a* is inserted between the layers, from top to bottom. The wrapped portions of the wide band 2*a* are fixed to each other by a sewing thread or the like to maintain a good appearance of the knot 4.

Before putting on the necktie, a loop formed by tie body 2 is enlarged by pulling the narrow band 2*b* upward through the core body 3 (in this case, a fastener 7 connecting the loop may be detached). Then the free end of the narrow band 2*b* is pulled downward through the core body 3 so that the necktie is snugly fitted around the neck. Thereafter, means for securing a length of the narrow band 2*b* in this position, such as a needle 6, is applied to the length of the narrow band 2*b* accommodated in the channel of the core body 3, as shown in FIG. 3, which means is inserted in a hole bored through the core body 3. Such means are also disclosed in the above U.S. Pat. No. 4,504,979.

The securing means disclosed in the above U.S. Patent, however, has a complicated structure formed of a plurality of members separate from the main part of the core body and is built-in to the core body. Therefore, the total cost for manufacturing and assembling the core body becomes expensive.

SUMMARY OF THE INVENTION

It is an object of the present invention to provide an improvement for a core body built-in to a ready-made knot of a necktie, without the drawbacks of the prior art described above.

It is another object of the present invention to provide a core body of a type described having a simple structure for fixing a narrow band of a tie body in position and releasing the same therefrom.

These objects are achievable, according to a first embodiment of the present invention, by a core body comprising an outer shell having a U-shape cross-section, in which the width converges downward, defined by side walls opposed and inclined to each other, and a front wall bridging the side walls. A partition is arranged inside the outer shell parallel to one of the side walls so that a channel having a uniform width is defined in the interior of the outer shell between the one side wall and the partition. A plate-like presser member is pivotably secured in the channel by a pin bridging the partition and the side wall defining the channel, substantially at a right angle, so that the presser member is pivotable about the pin within the channel. The presser member has a predetermined thickness so that a space in the U-shaped cross-section is defined between the inner wall of the channel and the outer surface of the presser member, to accommodate the narrow band of the tie body in the folded state. The presser member has an operating edge confronting the inner surface of the front wall of the core body, which edge is brought into frictional contact with the narrow band, whereby, on one hand, when the narrow band is pulled upward, the presser member is pivoted about the pin so that the lower portion of the operating surface is moved toward the front wall to block the space and prevent the narrow band from passing further upward through the space, and, on the other hand, when the narrow band is pulled downward, the presser member is pivoted in reverse about the pin so that the blocking of the space is released. This pivoting movement is limited by a stop means so that a space remains between the upper portion of the operating surface and the front wall of the outer shell which is large enough to allow the narrow band to pass further upward through the space.

In a second aspect of the present invention, an arm-like presser member is utilized in place of the plate-like presser, and is associated with a bar-like release member.

The core body according to the present invention may be made of a synthetic resin having both rigidity and resiliency, such as ABS resin, so that the outer shell and the presser member are assembled by utilizing an elastic deformation of the outer shell.

Accordingly, after the core body has been built-in to the ready-made necktie with the narrow band inserted through the U-shaped space, the narrow band can be freely pulled down to attain the most favorable fitting around a wearer's neck, while an upward pull of the narrow band is effectively inhibited by the braking action of the presser member, whereby unfavorable slack in the necktie during wear can be avoided. When the wearer wish to loosen the necktie, the presser member or the release member is rotated by hand to disengage the presser member from the narrow band, and the narrow band can be then pulled upward while the disengaged state is maintained.

BRIEF DESCRIPTION OF THE DRAWINGS

Other objects and advantages of the present invention will be made more apparent by the following description of the preferred embodiments with reference to the accompanying drawings, wherein

FIGS. 13 through 15 illustrate steps for forming a ready-made knot by utilizing the core body according to the present invention;

FIG. 16 is a sectional view of a knot in which the core body according to the first embodiment of the present invention is built-in;

FIG. 23 is a sectional view of a knot in which the core body according to the second embodiment of the present invention is built-in.

DESCRIPTION OF THE PREFERRED EMBODIMENTS

Figure 1:
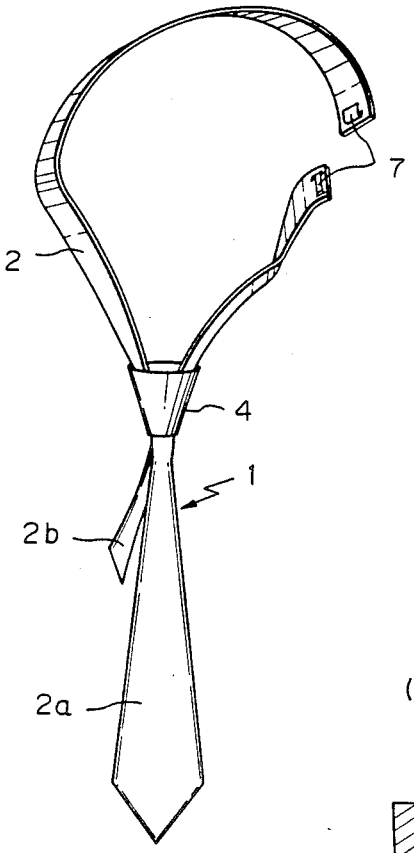
Fig. 1 (PRIOR ART)
FIG. 1 is an overall view of a necktie with a ready-made knot formed by a core body according to the present invention.

A first embodiment of a core body according to the present invention is shown in FIGS. 4 through 16. The core body 10 consists of three parts, namely, an outer shell 11, a presser member 12, and a release member 13. The outer shell 11 has a U-shaped cross-section defined by a pair of side walls 14*a* and 14*b* inclined to each other to form a downward convergence, and a front wall 15 bridging the side walls 14*a*, 14*b*. A partition 16 is provided within the interior of the outer shell 11 in parallel to one of the side walls (in this case the side wall 14*a*) so that an inclined straight channel 17 having a uniform width is formed between the side wall 14*a* and the partition 16.

The presser member 12 comprises an arm 20 having a serrated front edge 21. A pair of pins 19 are projected from both sides of a root portion of the arm 20, which pins 19 are engageable with corresponding apertures 18 provided on the upper parts of the side wall 14*a* and the partition 16, respectively, so that the presser member 12 is pivoted therebetween with the common axis of the pins 19 being perpendicular across the channel 17. A length of the arm 20 is designed such that the serrated edge 21 thereof is in contact with the front wall 15 when the presser member 12 is rotated clockwise in FIG. 6, and further rotation is inhibited. The presser member 12 is provided with a downwardly angled hook 22 at a rear end thereof.

Figure 6:
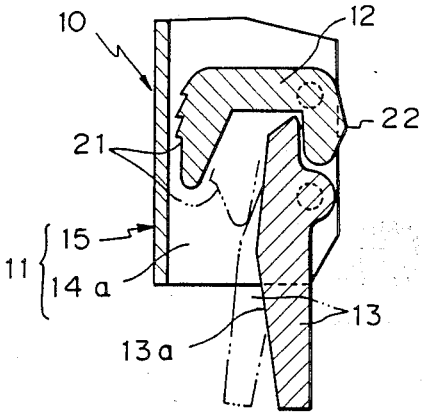
FIG. 6 is a side view of the core body of FIG. 4.
Figure 7:
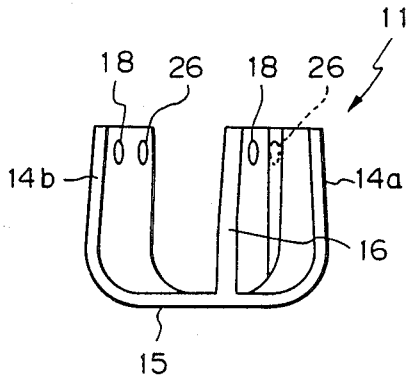
FIG. 7 is a top view of an outer shell of the core body of FIG. 4.
Figure 8:
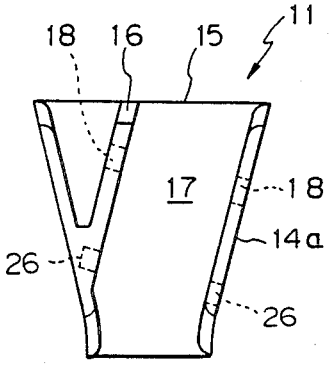
FIG. 8 is a back view of the outer shell of FIG. 7.
Figure 9:
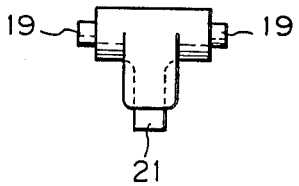
FIG. 9 is a top view of a presser member of the core body of FIG. 4.
Figure 11:
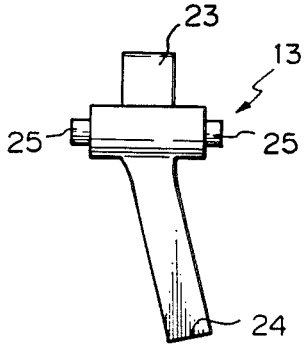
FIG. 11 is a back view of a release member of the core body of FIG. 4.
Figure 10:
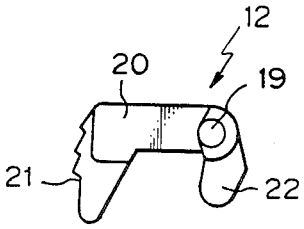
FIG. 10 is a side view of the presser member of FIG. 9.
Figure 12:
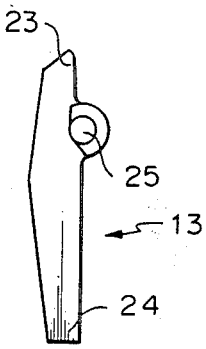
FIG. 12 is a side view of the release member of FIG. 11.

The release member 13 is a bar-like member, the upper portion of which forms an operating lever 23 for a hook 22, as described later. The lower portion of the release member 13 forms a handle lever 24, and a pair of pins 25 are projected from both sides of the release member 13 at a border between the operating lever 23 and the handle lever 24. These pins 25 are engageable with corresponding apertures 26 provided beneath the abovesaid apertures 18 for the pins 19 on the partition 16 and the side wall 14*a*, respectively, so that the release member 13 is pivoted therebetween, in parallel to the presser member 12. The operating lever 23 and the handle lever 24 are integrally connected to each other in such a manner that the operating lever 23 is perpendicular to the axis of the pins 25 and the handle lever 24 is inclined thereto. According to this structure, the operating lever 23 can be rotated in a plane including an axis of the channel 17, and on the other hand, the handle lever 24 can be rotated in another plane including an axis of the outer shell 11. In the assembled state, the release member 13 is positioned in the outer shell 11 with the operating lever 23 in contact with the inner surface of the hook 22 of the presser member 12, as shown in FIG. 6, and with the handle lever 24 extending out from the converged end of the outer shell 11. When the handle lever 24 is pushed forward, the operating lever 23 pushes back the hook 22 of the presser member 12 to rotate the presser member 12 counterclockwise in FIG. 6, until the inner surface of the serrated edge 21 is brought into contact with the back of the release member 13, at which the serrated edge 21 is positioned while confronting the inner surface of the front wall 15 with a gap sufficient to allow the narrow band 2*b* to pass therethrough, as shown by chain lines in FIG. 6.

Steps for incorporating the core body 10 into a knot of a necktie will be described below.

Figure 2:
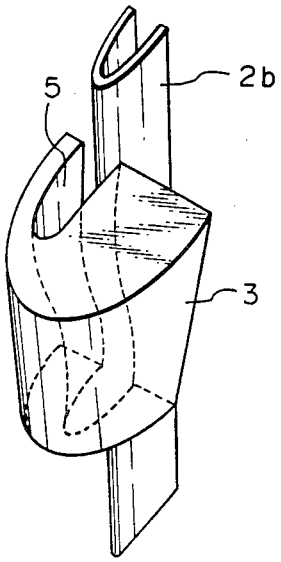
Fig. 2 (PRIOR ART)
FIG. 2 is a perspective view of a prior art core body with a narrow band of a tie body inserted in a folded state.
Figure 3:
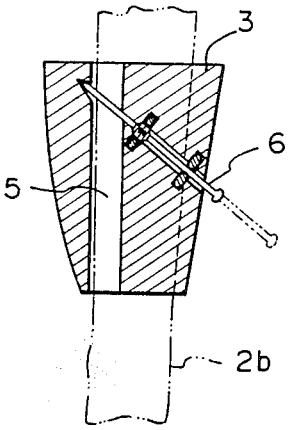
Fig. 3 (PRIOR ART)
FIG. 3 is a sectional view of a knot having a prior art core body with a securing means engaged with a narrow band.
Figure 4:
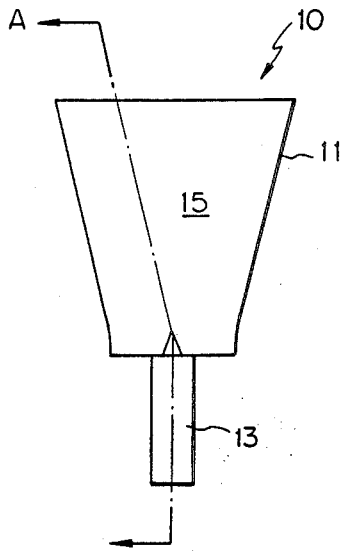
FIG. 4 is a front view of a core body according to a first embodiment of the present invention, in the assembled state.
Figure 5:
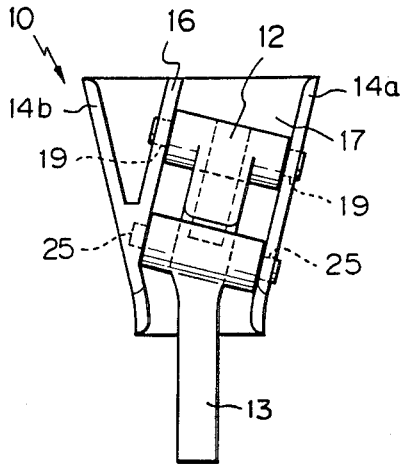
FIG. 5 is a back view of the core body of FIG. 4.

First, a narrow band 2*b* of a tie body 2 in a longitudinally folded state is inserted in the channel 17 of the outer shell 11 prior to assembly with the presser member 12, in the same manner as shown with reference to FIG. 2. Then the presser member 12 is mounted to the outer shell 11 in such a manner that the arm 20 is sandwiched between the respective halves of the folded narrow band 2*b*. Accordingly, the narrow band 2*b* is frictionally engaged with the serrated edge 21 of the arm. Next, the release member 13 is mounted to the outer shell 11 so that the relationship shown in FIG. 6 is attained between the outer shell 11 and the respective members 12, 13. Thereafter, a midportion of the tie body 2 is wrapped around the core body 10 to form two layers on the core body 10 (see FIGS. 13 and 14), and a free end of the wide band 2*a* is inserted between the layers, from top to bottom (see FIG. 15). The wrapped portions of the wide band 2*a* forming the knot are fixed to each other by a sewing thread or the like, to maintain a good appearance of the knot 4. It should be noted that the handle lever 24 is projected downward from the knot 4. To facilitate the assembly of the core body described above, the outer shell 11, the presser member 12, and the release member 13 are preferably made of a synthetic resin having both good rigidity and resiliency, such as ABS resin.

Figure 16:
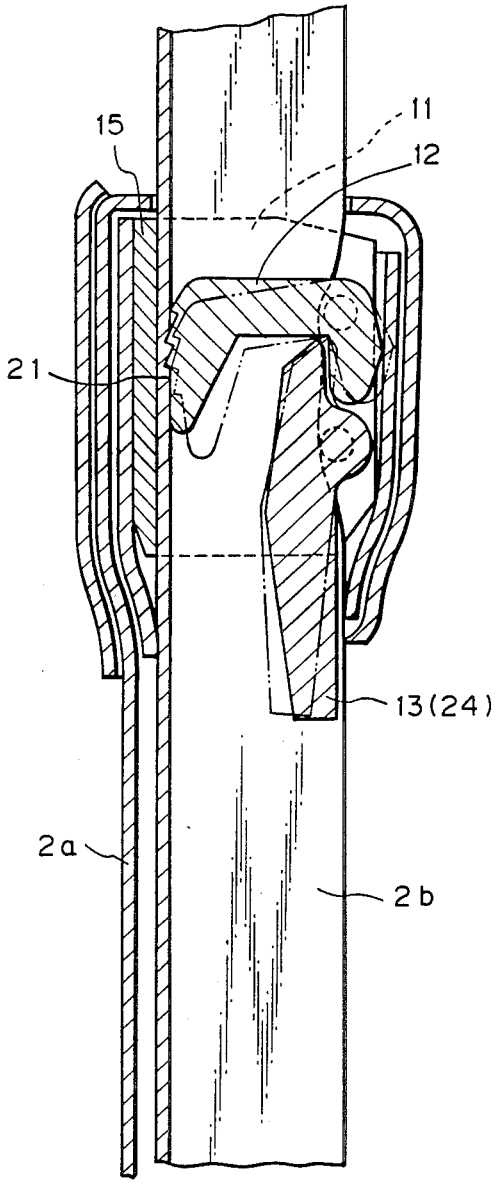
Figure 17:
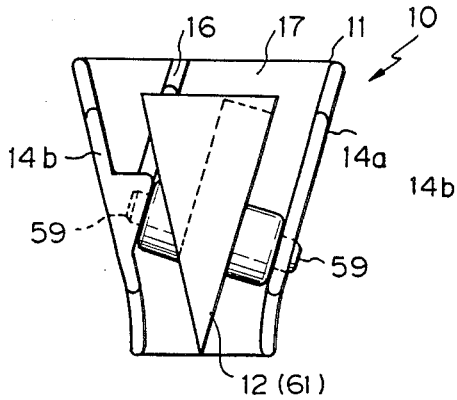
FIG. 17 is a back view of a core body according to a second embodiment of the present invention in the assembled state.
Figure 18:
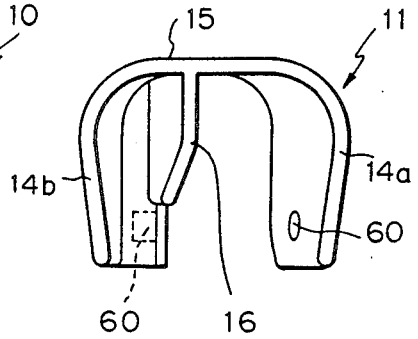
FIG. 18 is a top view of the core body of FIG. 17.
Figure 19:
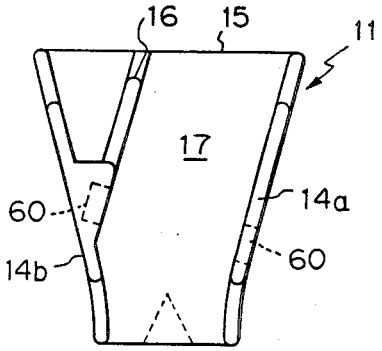
FIG. 19 is a back view of an outer shell of the core body of FIG. 17.
Figure 20:
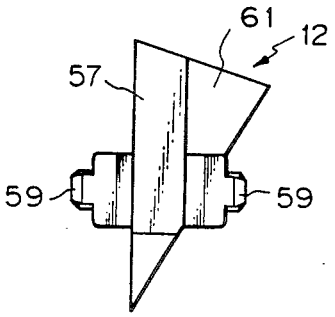
FIG. 20 is a front view of a presser member of the core body of FIG. 17.
Figure 21:
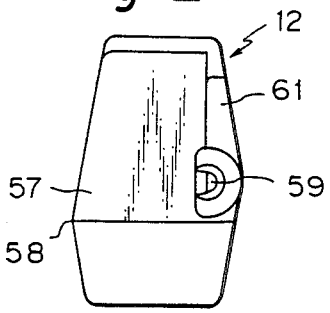
FIG. 21 is a side view of the presser member of FIG. 20.
Figure 22:
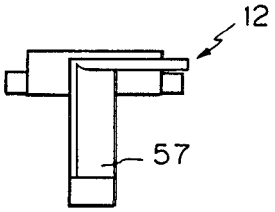
FIG. 22 is a top view of the presser member of FIG. 20.

According to the above structure of the knot 4, if the narrow band 2*b* is pulled upward through the core body 10, this upward movement of the narrow band 2*b* causes a clockwise pivoting motion of the presser member 12 in FIG. 16, due to frictional engagement of the serrated edge 21 with the narrow band 2b, and the presser member 12 occupies a position depicted by a solid line in FIG. 16 at which the narrow band 2b is securedly nipped between the serrated edge 21 and the front wall 15 of the outer shell 11. Therefore, further upward displacement of the narrow band 2b is immediately prevented and loosening of the necktie is avoided. However, if a pushing force is applied to the handle lever 24 of th release member 13 to counterclockwisely rotate the presser member 12, the engagement of the presser member 12 with the narrow band 2b is released and the narrow band 2b can be freely pulled upward so long as the pushing force is applied to the handle lever 24. This is the case when the necktie is put on or taken off.

On the contrary, if the narrow band 2b is pulled downward through the core body 10, the presser member 12 is counterclockwisely pivoted in FIG. 16. The serrated edge 21 then abuts against the back of the release member 13 so that a gap always remains between the serrated edge 21 of the presser member 12 and the outer shell 11, to allow the narrow band 2b to pass therethrough. This is the case when the necktie is adjusted to fit snugly around the wearer's neck.

A second embodiment of a core body according to the present invention is illustrated in FIGS. 17 through 23. The core body 10 consists of two parts, namely an outer shell 11 and a presser member 12. The outer shell 11 has a U-shaped cross-section defined by a pair of side walls 14a and 14b inclined to each other to form a downward convergence, and a front wall 15 bridging the side walls 14a, 14b. A partition 16 is provided within the interior of the outer shell 11 in parallel to one of the side walls (in this case the side wall 14a) so that an inclined straight channel 17 having a uniform width is formed between the side wall 14a and the partition 16.

The presser member 12 comprises a rotatable plate 57 of a predetermined width and having a convexed front edge 58. The plate 57 has a pair of projections 59 in a pin form at the middle region of the respective side surface of the plate 57, which pins 59 are engageable with corresponding apertures 60 of the side wall 14a and the partition 16, respectively, so that the plate 57 is pivoted therebetween with the common axis of the pins 59 being perpendicular across the channel 17 while keeping the posture of the plate 57 in parallel to the side wall 13a and the partition 16. The plate 57 has a laterally extended wall 61 in a triangular form fixedly secured along the back edge of the plate 57, which abuts against the partition 16 when the plate 57 is pivoted counterclockwise in FIG. 23, whereby a gap still remains between the front wall 15 and the front edge 58, which will allow a narrow band of a necktie accommodated in the channel 17, as described later, to pass therethrough. On the other hand, when the plate 57 is pivoted in reverse, the lower part thereof is directly engageable with the front wall 15 so that no gap remains therebetween.

Steps for incorporating the core body 10 into a knot of a necktie will be described below, with reference to FIGS. 13 through 15.

First, a narrow band 2b of a tie body 2 in a longitudinally folded state is inserted in the channel 17 of the outer shell 11 prior to assembly with the presser member 12, in the same manner shown with reference to FIG. 2. Then the presser member 12 is mounted to the outer shell 11 in such a manner that the plate 57 is sandwiched between halves of the folded narrow band 2b. Accordingly, the narrow band 2b is frictionally engaged with the front edge 58 of the plate 57 and held in the U-shaped space defined between the outer shell 11 and the plate 57. Thereafter, a midportion of the tie body 2 is wrapped around the core body 10 to form two layers on the core body 10 (see FIGS. 13 and 14), and a free end of the wide band 2a is inserted between the layers from top to bottom (see FIG. 15). The wrapped portions of the wide band 2a forming the knot are fixed to each other by a sewing thread or the like to maintain a good appearance of the knot 4.

Figure 23:
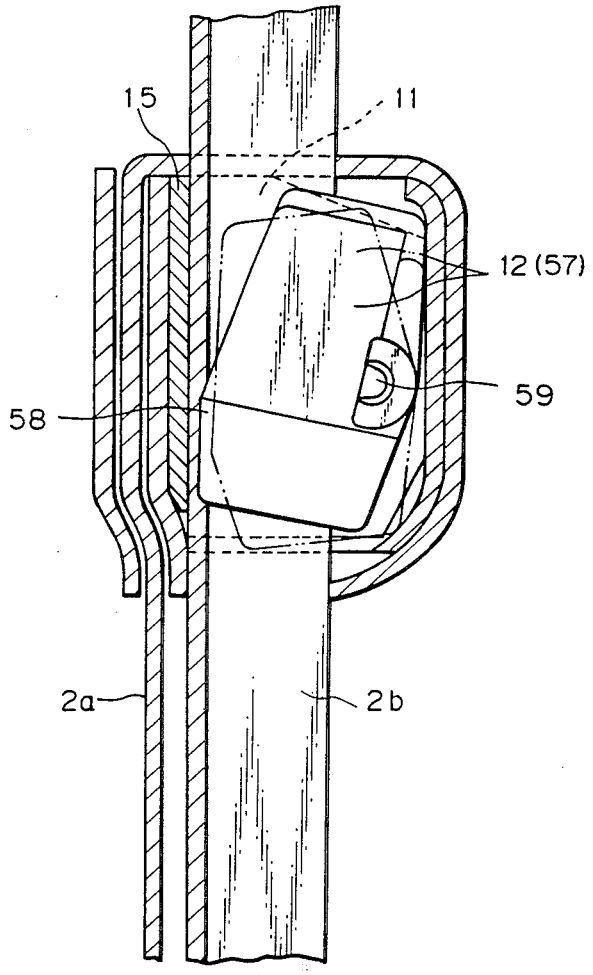

According to the above structure of the knot 4, if the narrow band 2b is pulled upward through the core body 10, this upward movement of the narrow band 2b causes a clockwise pivoting motion of the presser member 12 in FIG. 23, due to frictional engagement of the plate 57 with the narrow band 2b, and the plate 57 occupies a position depicted by a solid line in FIG. 23 at which the narrow band 2b is securedly nipped between the plate 57 and the front wall 15 of the outer shell 11. Thereby, further upward displacement of the narrow band 2b is immediately prevented and loosening of the necktie is avoided. However, if a pushing force is applied to the upper part of the extended wall 61 to rotate the presser member 12 counterclockwise, the engagement of the presser member 12 with the narrow band 2b is released and the narrow band 2b can be freely pulled upward so long as the pushing force is applied to the extended wall 61. This is the case when the necktie is put on or taken off.

On the contrary, if the narrow band 2b is pulled downward, without the abovesaid pushing force, through the core body 10, the presser member 12 is pivoted counterclockwise in FIG. 23. The laterally extended wall 61 of the plate 57, then abuts against the partition 16 so that a space remains between the front edge 58 of the plate 57 and the outer shell 11, to allow the narrow band 2b to pass therethrough. This is the case when the necktie is adjusted to fit snugly around the wearer's neck.

In this embodiment, the core body 10 is completely concealed within the knot 4 and the releasing operation of the presser member 12 is carried out by touch alone.

According to the present invention, a knot of a necktie can be neatly formed, and can easily be put-on and taken-off without damaging the shape of the knot.

I claim:

1. A core body to be built-in to a ready-made knot of a necktie, comprising;

an outer shell having a U-shaped crosssection, a width of which converges downward, defined by side walls opposed and inclined to each other and a front wall bridging the side walls;

a partition arranged inside of the outer shell parallel to one of the side walls so that a channel having a uniform width is defined in the interior of the outer shell between one side wall and the partition; and a plate-like presser member pivotably secured in the channel by a pin bridging the partition and the side wall defining the channel substantially at a right angle so that the presser member is pivotable about the pin within the channel;

the presser member being of a predetermined thickness so that a space of a U-shaped cross-section is defined between the inner wall of the channel and the outer surface of the presser member, for accommodating the narrow band of the tie body in the folded state and having an operating edge confronting the inner surface of the front wall of the core body, which edge is brought into frictional contact with the narrow band, whereby on one hand, when the narrow band is pulled upward, the presser member is pivoted about the pin so that the lower portion of the operating surface is pushed toward the front wall to block the space so as to prevent the narrow band from passing further upward through the space and on the other hand, when the narrow band is pulled downward, the presser member is pivoted in reverse about the pin so that the blocking of the space is released, which pivoting movement is limited by a stop means so that enough space remains between the upper portion of the operating surface and the front wall of the outer shell to pass the narrow further downward through the space.

2. A core body as defined in claim 1, wherein the stop means is a triangular wall laterally extended from a rear edge of the presser member.

3. A core body as defined in claim 1, wherein the respective parts of the core body are made of ABS resin.

4. A core body to be incorporated in a knot of a necktie handle, comprising;

an outer shell having a U-shaped crosssection, a width of which converges downward, defined by side walls opposed and inclined to each other and a front wall bridging the side walls;

a partition arranged inside of the outer shell parallel to one of the side walls so that a channel having a uniform width is defined in the interior of the outer shell between the one side wall and the partition; and an arm-like presser member pivotably secured in the channel by a first pin bridging the partition and the side wall defining the channel substantially at a right angle so that the presser member is pivotable about the first pin within the channel; the presser member having a serrated front edge confronting the front wall of the outer shell and a downwardly angled rear hook, so that a space of a U-shaped cross-section is defined between the inner wall of the channel and the outer surface of the presser member, for accommodating the narrow band of the tie body in the folded state therethrough; and a bar-like release member pivotably secured in the channel by a second pin bridging the partition and the side wall beneath and parallel to the first pin so that the upper portion of the release member is in contact with the inner surface of the rear hook of the presser member and the lower portion of the release member is projected downward from the channel of the outer shell.

5. A core body as defined in claim 4, wherein the respective parts of the core body are made of ABS resin.

* * * * *